US009518538B2

(12) United States Patent
Pearce

(10) Patent No.: US 9,518,538 B2
(45) Date of Patent: Dec. 13, 2016

(54) VARIABLE RESTRICTION FUEL VAPOR CANISTER

(71) Applicant: Ford Global Technologies, LLC, Dearborn, MI (US)

(72) Inventor: Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 622 days.

(21) Appl. No.: 13/646,487

(22) Filed: Oct. 5, 2012

(65) Prior Publication Data

US 2014/0096750 A1 Apr. 10, 2014

(51) Int. Cl.
*F02M 25/08* (2006.01)

(52) U.S. Cl.
CPC ..... *F02M 25/0818* (2013.01); *F02M 25/089* (2013.01); *F02M 25/0854* (2013.01)

(58) Field of Classification Search
CPC F02M 25/08; F02M 25/0836; F02M 25/0854; F02M 25/0872; F02M 25/0818; F02D 41/0032; F02D 41/0045; F02D 41/003; F02D 41/0042; B60K 15/03504
USPC ..... 123/516, 518, 519, 520
See application file for complete search history.

(56) References Cited

U.S. PATENT DOCUMENTS 4,326,489 A 4/1982 Heitert
4,741,318 A 5/1988 Kortge et al.
4,995,369 A 2/1991 Cook
5,050,568 A 9/1991 Cook
5,117,797 A 6/1992 Telep et al.
5,199,404 A 4/1993 Cook et al.
5,226,398 A 7/1993 Cook et al.
5,273,020 A 12/1993 Hayami
5,363,832 A 11/1994 Suzumura et al.
5,460,136 A * 10/1995 Yamazaki ..... F02M 25/0854 123/519
5,564,398 A * 10/1996 Maeda ..... F02M 25/0854 123/519
5,647,332 A * 7/1997 Hyodo ..... F02M 25/0836 123/519
5,970,958 A 10/1999 DeLand et al.
6,537,354 B2 * 3/2003 Meiller ..... F02M 25/0854 123/519
6,845,755 B2 1/2005 Cook et al.
7,640,920 B2 * 1/2010 Makino ..... F02M 25/0836 123/520
7,809,491 B1 10/2010 Bevan et al.
7,966,996 B1 6/2011 Pursifull
9,057,345 B2 * 6/2015 Lee ..... F02M 25/0854
(Continued)

OTHER PUBLICATIONS

Anonymous, "An Evap System With Energy Saving Latchable Valves," IPCOM No. IPCOM000237278D, Published Jun. 11, 2014, 2 pages.

(Continued)

*Primary Examiner* — Sizo Vilakazi
(74) *Attorney, Agent, or Firm* — James Dottavio; Alleman Hall McCoy Russell & Tuttle LLP

(57) ABSTRACT

Systems and methods for operating an engine with a fuel vapor recovery system are disclosed. In one example approach, a method for an engine with a fuel vapor recovery system comprises increasing an amount of flow restriction between storage material in a fuel vapor canister while maintaining a vent valve open during a fuel vapor purging event.

19 Claims, 4 Drawing Sheets

(56) References Cited

U.S. PATENT DOCUMENTS

| | | | | |
|---|---|---|---|---|
| 2004/0173190 | A1* | 9/2004 | Makino | F02D 41/004 123/520 |
| 2005/0022796 | A1* | 2/2005 | Zuchara | B01D 53/0415 123/519 |
| 2010/0223984 | A1* | 9/2010 | Pursifull | F02M 25/0836 73/114.39 |
| 2012/0285238 | A1* | 11/2012 | Liu | B60K 15/03 73/290 R |

OTHER PUBLICATIONS

Anonymous, "Method to Adsorb Crankcase Blow-by Gas Hydrocarbons Into Evap Canister during Engine Non-Combusting Modes," IPCOM No. IPCOM000238215D, Published Aug. 8, 2014, 2 pages.

* cited by examiner

VARIABLE RESTRICTION FUEL VAPOR CANISTER

BACKGROUND/SUMMARY

Vehicles may be fitted with fuel vapor recovery systems wherein vaporized hydrocarbons (HCs) released from a fuel tank (for example, during refueling) are captured and stored in a fuel vapor canister packed with an adsorbent, such as charcoal or carbon. At a later time, when the engine is in operation, the fuel vapor recovery system may use a vacuum (or pressure) to purge the vapors into the engine intake manifold for use as fuel. The purge flow vacuum (or pressure) may be generated by one or more pumps and/or ejectors or by pressures in the engine intake manifold.

However the inventor herein has recognized that while it may be desirable for a fuel vapor canister to have a low flow restriction for venting, e.g., during refueling events, this is counter to the other function of the canister that is to allow purge of the canister. For example, during a fuel vapor purge event, if flow restriction through the canister is low then a substantial amount of fuel vapor may remain in the canister after the purge leading to an increase in bleed emissions, for example. For example, during a fuel vapor purging event with low restriction in the canister, corners or edges of the fuel vapor canister may not be cleaned out.

In order to address these issues, in one example approach a method for an engine with a fuel vapor recovery system is provided. The method comprises increasing an amount of flow restriction between storage material in a fuel vapor canister while maintaining a vent valve open during a fuel vapor purging event.

In this way, a low flow restriction in the canister may be present during venting events whereas an increased flow restriction between storage material in the canister may be used during fuel vapor purging to sufficiently purge the fuel vapor stored in the canister. Further, by changing flow restriction between storage material in the canister, e.g., via restricting communication between charcoal beds of the canister, an increase in purging efficiency may be obtained without relying on changing air flow or vacuum provided to the canister by the engine during the purging event. Increased efficiency of fuel vapor purging may lead to lower bleed emissions, for example.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
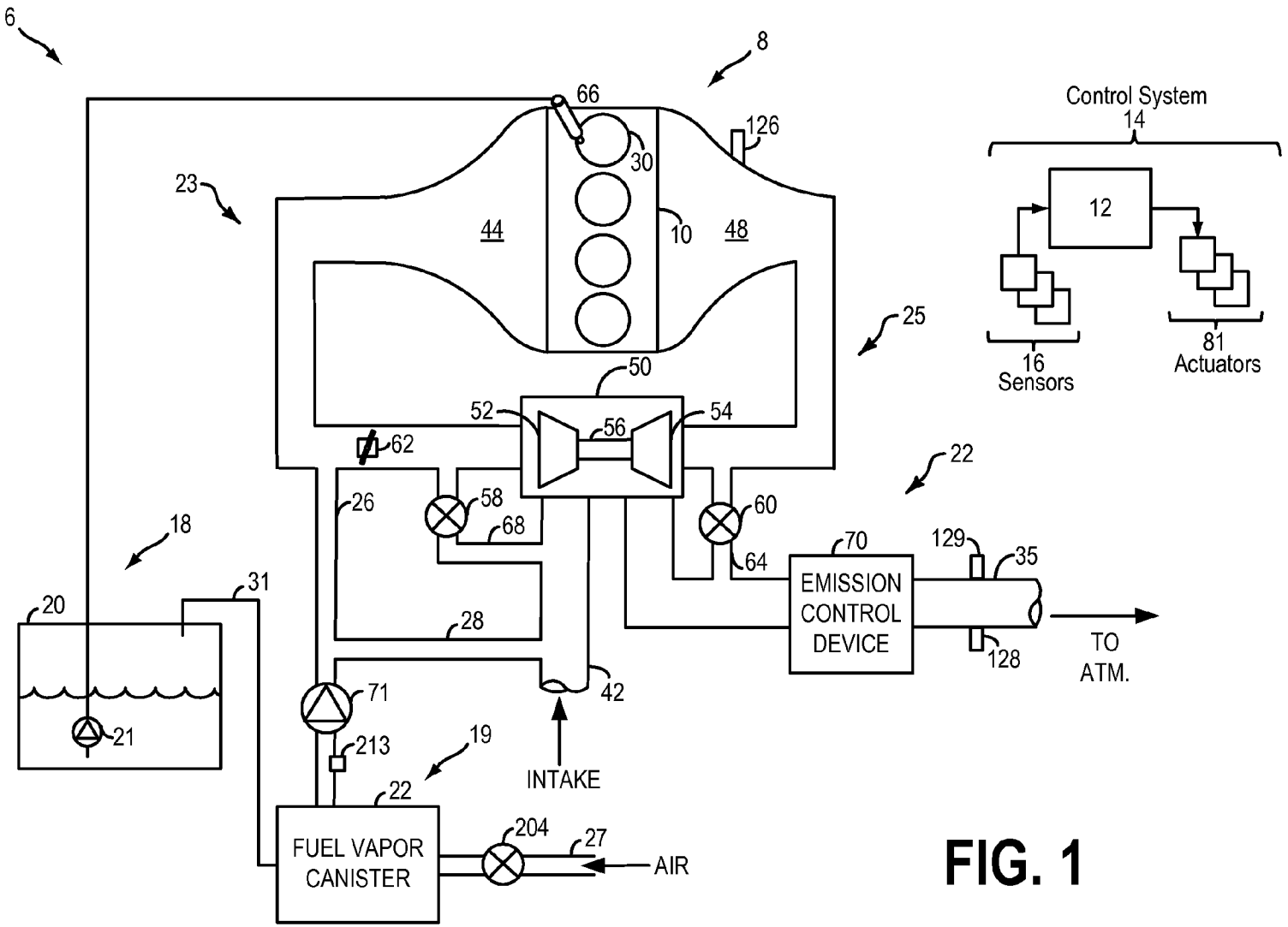
FIG. 1 shows a schematic depiction of an engine with a fuel vapor recovery system.
Figure 3:
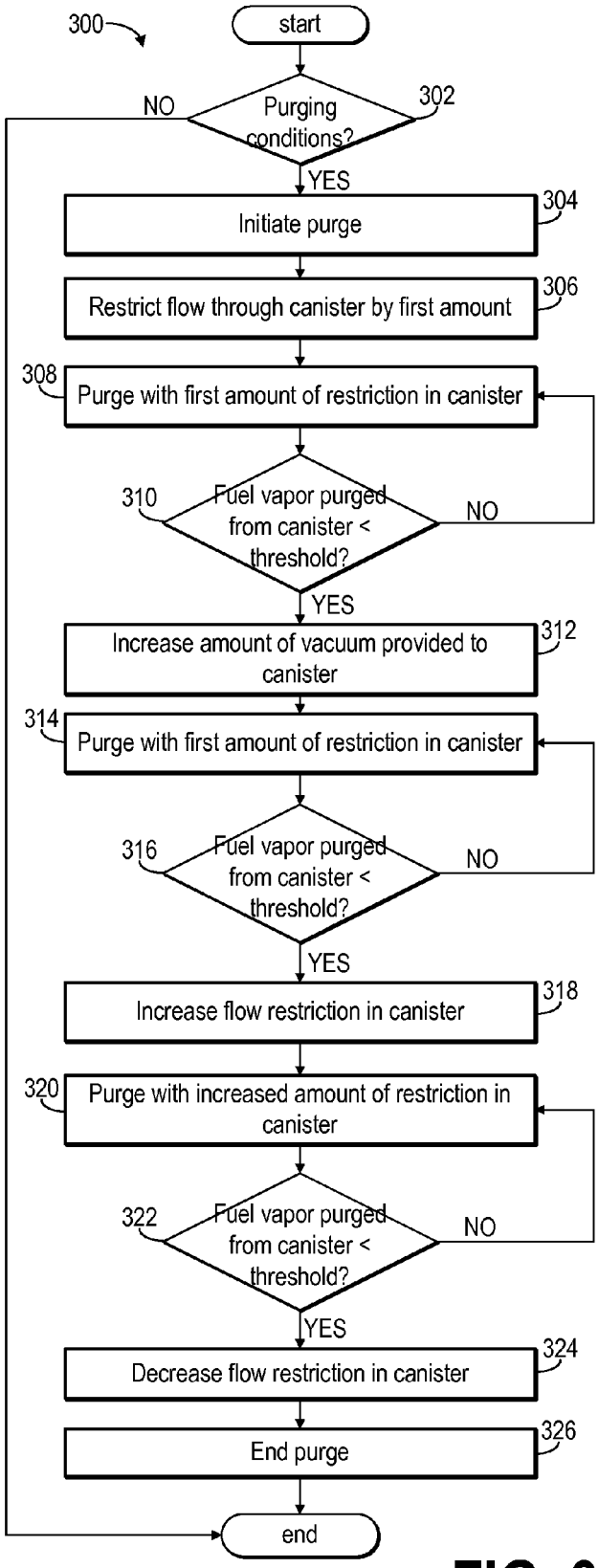
FIG. 3 shows an example method for operating an engine with a fuel vapor recovery system in accordance with the disclosure.
Figure 4:
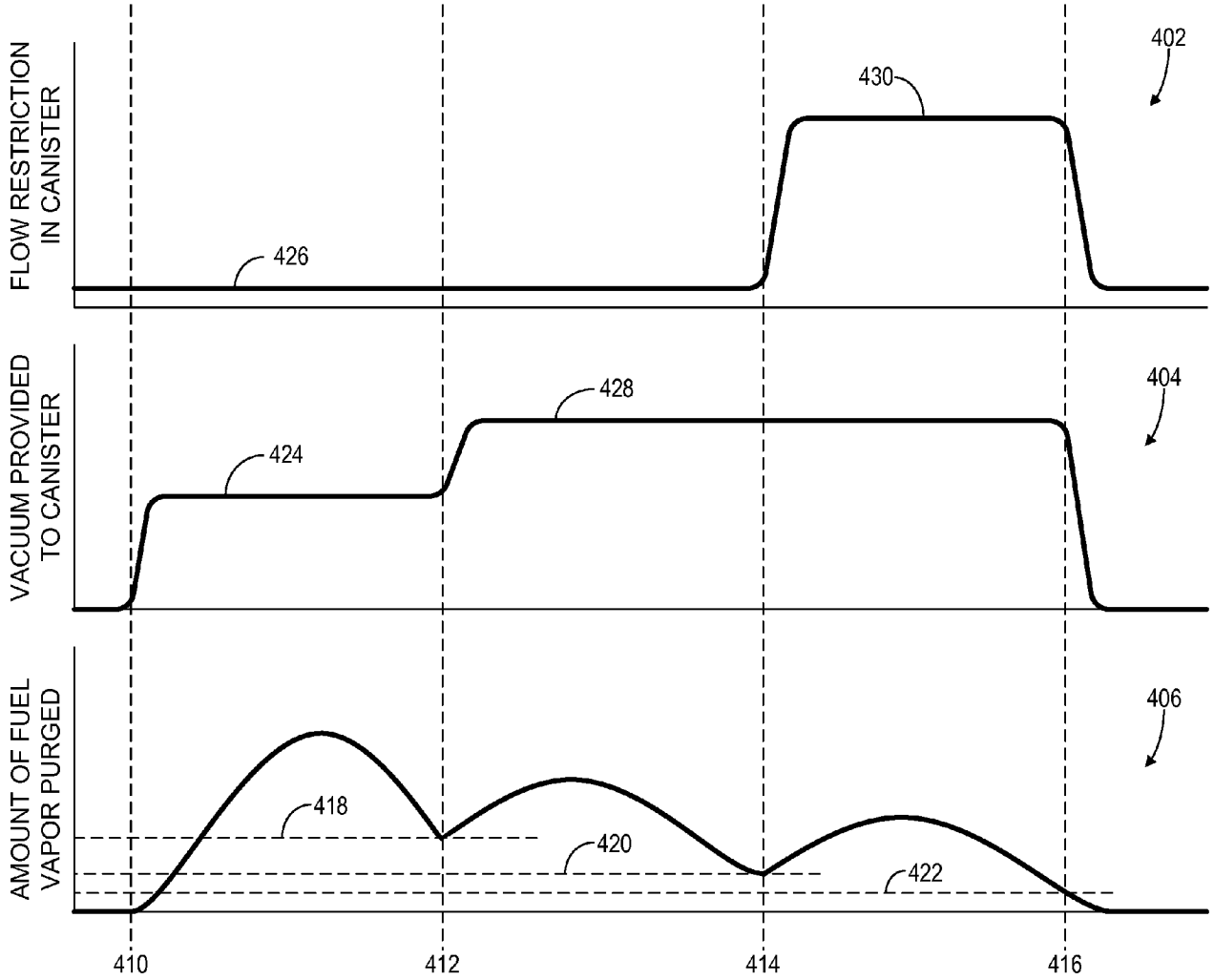
FIG. 4 shows example graphs of operating conditions of a fuel vapor canister in accordance with the disclosure.

The following description relates to systems and methods for operating an engine with a fuel vapor recovery system, such as the engine shown in FIG. 1. An amount of flow restriction between storage material in a fuel vapor canister, such as the fuel vapor canister shown in FIG. 2, may be adjusted in response to engine operating conditions so that the canister has low restriction between storage material when vented to the atmosphere, e.g., during refueling, and a high flow restriction between storage material during fuel vapor purging events to increase an amount of fuel vapor purged from the canister. In some examples, as shown in FIGS. 3-4, flow restriction adjustments may be performed together with purge vacuum adjustments to increase efficiency of a fuel vapor purge cycle.

FIG. 1 shows a schematic depiction of a vehicle system 6 including an engine system 8 coupled to a fuel vapor recovery system 19 and a fuel system 18. Fuel vapor recovery system 19 includes a fuel vapor canister 22 which may capture and store vaporized hydrocarbons (HCs) released from a fuel tank (for example, during refueling) in a storage material contained therein. As described in more detail below with regard to FIG. 2, fuel vapor canister 22 may comprise a plurality of storage material, e.g., two or more, adsorbent beds in fluid communication with each other. Each adsorbent bed may include a suitable adsorbent, such as activated charcoal, for trapping fuel vapor in the fuel vapor recovery system.

The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The engine exhaust 25 includes an exhaust manifold 48 leading to an exhaust passage 35 that routes exhaust gas to the atmosphere. The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors.

Throttle 62 may be located in intake passage 42 downstream of a boosting device, such as turbocharger 50, or a supercharger. Turbocharger 50 may include a compressor 52, arranged between intake passage 42 and intake manifold 44. Compressor 52 may be at least partially powered by exhaust turbine 54, arranged between exhaust manifold 48 and exhaust passage 35. Compressor 52 may be coupled to exhaust turbine 54 via shaft 56. Compressor 52 may be configured to draw in intake air at atmospheric air pressure and boost it to a higher pressure. Using the boosted intake air, a boosted engine operation may be performed. However, in other examples, engine system 8 may be a normally aspirated engine and may not include a boosting device.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine 54 via turbine bypass passage 64, as controlled by wastegate 60. The position of wastegate 60 may be controlled by a wastegate actuator (not shown) as directed by controller 12. In one example, the wastegate actuator may be a vacuum-driven solenoid valve.

An amount of boost may additionally or optionally be controlled by controlling an amount of intake air directed through compressor 52. Controller 12 may adjust an amount of intake air that is drawn through compressor 52 by adjusting the position of compressor bypass valve 58 in compressor bypass passage 68. In one example, when a larger amount of boost is requested, a smaller amount of intake air may be directed through the compressor bypass passage.

Fuel system 18 may include a fuel tank 20 coupled to a fuel pump system 21. The fuel pump system 21 may include one or more pumps for pressurizing fuel delivered to fuel injectors 66 of engine 10. While only a single fuel injector 66 is shown, additional injectors are provided for each cylinder. It will be appreciated that fuel system 18 may be a return-less fuel system, a return fuel system, or various other types of fuel system. A fuel pump may be configured to draw the tank's liquid from the tank bottom.

Vapors generated in fuel system 18 may be routed to a fuel vapor canister 22 via conduit 31, before being purged to the engine intake 23. As further elaborated below, during a purging condition, air may be drawn in through the fuel vapor canister through vent 27 and canister vent valve 204. Fuel tank vapors may be vented through the tank top. The fuel tank 20 may hold a plurality of fuels, including fuel blends.

Fuel vapors stored in fuel vapor recovery system may be purged to engine intake 23 during purging conditions. Specifically, a purge flow may be driven by purge pump 71, and may be directed to the engine intake post-throttle, along first conduit 26, and/or into the pre-compressor engine air inlet, along second conduit 28. In some examples, an ejector may be coupled, in series, downstream of the purge pump to generate a vacuum for purging. However, in other examples, a purge valve may be disposed in conduit 26 and opened during fuel vapor purging events so that vacuum generated in the engine intake manifold may be used to purge fuel vapor from the fuel vapor canister. In some examples, such a purge valve may be used in addition to an ejector and/or pump to provide vacuum to the fuel vapor canister during purging.

Vehicle system 6 may further include control system 14. Control system 14 is shown receiving information from a plurality of sensors 16 and sending control signals to a plurality of actuators 81. As one example, sensors 16 may include exhaust gas sensor 126 (located in exhaust manifold 48), temperature sensor 128 and pressure sensor 129 (located downstream of emission control device 70). Other sensors such as additional pressure, temperature, air/fuel ratio, and composition sensors may be coupled to various locations in the vehicle system 6. Further, a sensor 213 may be included in conduit 26 to measure an amount of fuel being purged from fuel vapor canister 22. For example, sensor 213 may be an air/fuel sensor or any other suitable sensor for measuring an amount of fuel in conduit 26. As another example, actuators 81 may include fuel injectors 66, throttle 62, compressor 52, purge pump 71, a fuel pump of pump system 21, wastegate 60, wastegate actuators, compressor bypass valve 58, etc. The control system 14 may include an electronic controller 12. The controller may receive input data from the various sensors, process the input data, and trigger the actuators in response to the processed input data based on instruction or code programmed therein corresponding to one or more routines.

Figure 2:
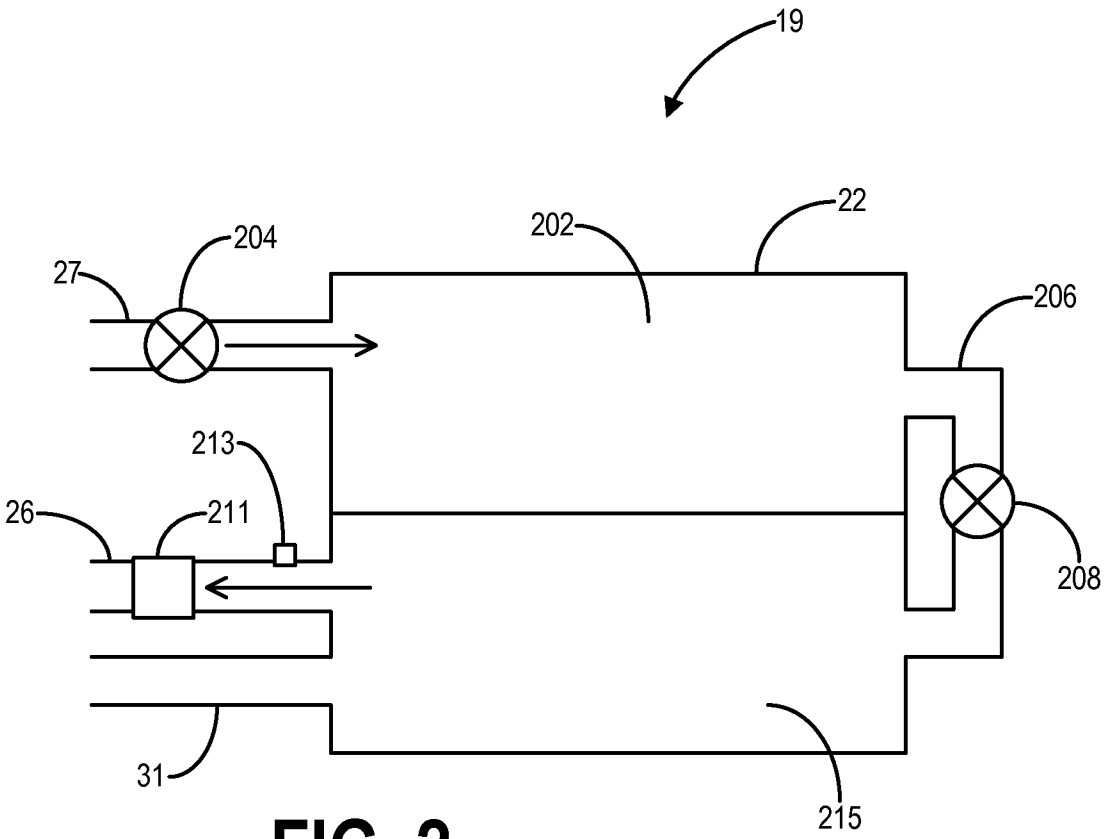
FIG. 2 shows an example fuel vapor canister in accordance with the disclosure.

FIG. 2 schematically shows an example fuel vapor canister 22 in a fuel vapor recovery system 19. Like numbered elements in FIG. 2 correspond to like numbered elements in FIG. 1. Fuel vapors from a fuel tank, e.g., fuel tank 20 shown in FIG. 1, may be directed to canister 22 via conduit 31 before being vented to the atmosphere via vent 27.

Atmosphere vent 27 is coupled to canister 22 so that air may be drawn through canister 22 during a fuel vapor purging event. For example, a vent valve 204 disposed in vent 27 may be opened in response to an initiation of a fuel vapor purging event so that air from the atmosphere may be drawn through canister 22. A purge flow may be driven by a vacuum created in conduit 26. For example, vacuum generated by an intake of the engine may be directed through conduit 26 and controlled via a purge valve 211 and/or a pump 71 coupled to conduit 26.

As remarked above, canister 22 may include multiple adsorbent beds connected together so that air flows through each of the beds during a purge event. In the example shown in FIG. 2, canister 22 includes a first adsorbent bed 202 and a second adsorbent bed 215. Each adsorbent bed may include a suitable fuel vapor adsorbent such as activated charcoal or the like. First bed 202 is fluidically coupled to second bed 215 via a conduit 206 which permits air to pass between the two different beds. Conduit 206 includes a restriction valve 208 which is adjustable to control an amount of flow communication between the two beds. The restriction valve could be a variable valve or a set position valve (open fully or at set points like 75%, 50% and 25%) to change the air-flow characteristics through the carbon canister. For example, during a fuel vapor purging event, as indicated by the arrows shown in FIG. 2, vent valve 204 may be opened so that air is drawn from vent 27 through first bed 202 and then through bed 215 into conduit 26 which is coupled to an engine intake. Vacuum present in conduit 26, from the pump or engine, drives the flow of air through canister 22 to purge the fuel stored in the canister. Though FIG. 2 shows two adsorbent beds, any number of adsorbent beds may be fluidically coupled together in canister 22. In turn, the fluidic communication between any two adsorbent beds in canister 22 may be controlled by corresponding restriction valves.

Under certain conditions, vent valve 204 may remain closed; however, during venting events, such as during refueling, vent valve 204 may be opened to a fixed set-point so that the fuel tank may be vented to the atmosphere while the canister filters and stores fuel vapor. During these venting events, restriction valve 208 may remain open in a fully open position so that a low flow restriction of air and gases passing between the beds or storage material of the canister is present. As described below with regard to FIG. 3, restriction valve 208 may remain in a fully open position until a fuel vapor purging event at which point it may be adjusted to increase a flow restriction between beds of the fuel vapor canister. For example, restriction valve 208 may be partially closed during fuel vapor purging so that flow is restricted between the storage material in the canister to more thoroughly clean out the fuel vapor stored in the canister, e.g., to clean out fuel vapor stored in the corners or along the edges of the beds.

FIG. 3 shows an example method 300 for operating an engine with a fuel vapor recovery system where flow restriction adjustments are performed in a fuel vapor canister together with optional purge vacuum adjustments to increase efficiency of a fuel vapor purge cycle. FIG. 4 illustrates the steps of method 300 by showing example graphs of operating conditions of a fuel vapor canister during an execution of method 300. In particular, FIG. 4 shows a graph of flow restriction between storage material in the canister at 402, vacuum provided to the canister at 404, and amount of fuel vapor purged from the canister at 406 as a function of time throughout an example implementation of method 300. FIG. 4 will be described concurrently with FIG. 3.

At 302, method 300 includes determining if purging conditions are met. Purging conditions may be confirmed based on various engine and vehicle operating parameters, including an amount of hydrocarbons stored in canister 22 being greater than a threshold, the temperature of emission control device 70 being greater than a threshold, a temperature of canister 22, fuel temperature, the number of engine starts since the last purge operation (such as the number of starts being greater than a threshold), a duration elapsed since the last purge operation, fuel properties, and various others. As another example, purging could occur for an onboard diagnostics (OBD) hardware check, or altitude adjustment for engine operation.

If purging conditions are met at 302, method 300 proceeds to 304 to initiate a purge event as shown at time 410 in FIG. 4. Initiating a fuel vapor purging event may include opening a vent valve coupled to the fuel vapor canister and maintaining the vent valve open at a set-point throughout a duration of the fuel vapor purging event. For example, a controller may open canister vent valve 204 (for example, by energizing a canister vent solenoid) to a fixed open position and maintain the vent valve open at the fixed position without any adjustments to the position of the vent valve throughout the entire fuel vapor purging event. By maintaining the vent valve open in a fixed position through a fuel vapor purging event, fresh air may be drawn in through vent 27 to purge fuel vapor stored in the fuel vapor canister.

In some examples, initiating a purge event may also include calculating a purge vacuum for a desired purge rate. For example, air pressure and air temperature in conduit 26 or in intake manifold 44 may be determined so that component adjustment may be performed to achieve a desired purge rate. Further, when a pump, such as pump 71, is used to provide vacuum to canister 22 during purging, initiating a purge event may also include calculating a purge valve duty cycle, or other control signal, based on a desired purge flow rate. For example, controller 48 may adjust purge valve 211 to achieve the desired purge flow rate. The amount of vacuum provided to the canister at the purging initiation event may be fixed but subsequently adjusted in response to operating conditions as described below. For example, as shown in FIG. 4 at 404, immediately following the initiation of a purge event at 410, an amount of vacuum provided to the fuel vapor canister may be increased to a first value 424 and then may be further adjusted in response to operating conditions as described below.

At 306, method 300 includes restricting flow between storage material in the fuel vapor canister by a first amount. In some examples, the first amount of restriction may be a minimum amount of flow restriction between the adsorbent beds of the fuel vapor canister. For example, restriction valve 208 may be set to a fully open position so that flow between the first and second beds of the canister is not restricted. In other examples, the first amount of restriction may correspond to the restriction valve being adjusted to a first partially open set-point value to partially impede communication of flow between the adsorbent beds of the canister. For example, as shown in FIG. 4 at 402, the first amount of restriction between storage material in the fuel vapor canister may be set to a first value 426. This first value 426 may be an amount of flow restriction between storage material in the canister corresponding to the restriction valve being fully open. This fully open position of restriction valve 208 provides a low flow restriction between storage material in the canister which is used during venting events as well.

At 308, method 300 includes purging fuel vapor from the fuel vapor canister with the first amount of restriction between storage material in the fuel vapor canister. In particular, the vacuum provided to the fuel vapor canister via the engine and/or pump in conduit 26 is used to pull air from vent 27 through the first adsorbent bed 202 and then through the second adsorbent bed 215 while the restriction valve 208 is set at the first position. As remarked above, the first position of restriction valve 208 may be a fully open position or a partially closed position. For example, as shown in FIG. 4 at 406, following initiation of a purging event at 410, the amount of fuel vapor purged from the canister increases as air is drawn through the fuel vapor canister from vent 27 to conduit 26. The fuel vapor purged from canister 22 is then fed back to the engine via conduit 26 for combustion.

At 310, method 300 includes determining if an amount of fuel vapor purged from the canister is less than a threshold. The amount of fuel vapor may be a concentration of fuel in the purge flow (fuel fraction), a fuel mass flow rate, etc. For example, sensor 213 may measure an amount of fuel vapor purged from the canister and determine if an amount of fuel vapor, e.g., a fuel fraction, exiting the canister is less than a threshold value. In some examples, the threshold may be a first threshold 418 as shown at 406 in FIG. 4. This first threshold 418 may follow a decrease in the amount of fuel vapor purged from the canister following an increase in the amount of fuel vapor purged.

If an amount of fuel vapor purged from the canister is not less than a threshold at 310, method 300 continues to purge the fuel vapor canister with the first amount of restriction in the canister at 308. However, if at 310 an amount of fuel vapor purged from the canister is less than a threshold, for example less than first threshold 418, then method 300 proceeds to 312.

At 312, method 300 may optionally include increasing an amount of vacuum provided to the fuel vapor canister. In particular, in some examples, an amount of vacuum provided to the canister may be increased before an amount of flow restriction between storage material in the canister is increased as described below. This increase in vacuum provided to the canister may further clean out fuel vapors stored in the canister which were not purged at the lower vacuum provided in step 308. For example, a purge valve in the purge conduit may be adjusted or a duty-cycle of a pump in the purge conduit may be increased before adjusting the restriction valve to increase an amount of vacuum provided to the fuel vapor canister during a fuel vapor purging event. These adjustments may be performed in response to an amount of fuel purged from the fuel vapor canister less than a threshold. For example, as shown in FIG. 4, at time 412 the amount of fuel vapor purged from the canister falls below first threshold 418 and, in response, vacuum provided to the canister is increased from a first value 424 to a larger value 428 as shown at 404. Further, at 312, method 300 may also include adjusting a fuel injection amount in response to the increase in vacuum provided to the canister. For example, the amount of injection may be varied if the canister is still able to produce fuel vapor, by cleaning out the corners more efficiently in the carbon canister, the injection could be reduced slightly if the system can compensate adequately for the small amount.

However, in other examples, method 300 may not include any adjustment to an amount of vacuum provided to the fuel vapor canister and may instead skip to step 318 to increase an amount of flow restriction between storage material in the canister to further purge stored fuel vapors which were not purged at step 308. As described below, simply increasing the amount of flow restriction between storage material in the canister during a fuel vapor purging event may increase an efficiency of the purging process by dislodging fuel stored in the corners or edges of the canister.

At 314, method 300 optionally includes purging the fuel vapor canister with the first amount of restriction with the increased vacuum. As shown in FIG. 4 at 406, the increase in vacuum provided to the canister may lead to an increase in the amount of fuel vapor purged after time 412. However, the amount of fuel vapor purged during this step may be less than the amount of fuel vapor purged during step 308 since less fuel vapor is stored in the canister during this time.

At 316, method 300 includes determining if an amount of fuel vapor purged from the canister is less than a threshold. In some examples, this threshold may be a second threshold 420 as shown in FIG. 4 at 406. This second threshold 420 may be less than the first threshold 418 in some examples. However, in other examples, the second threshold may be substantially the same as the first threshold or greater than the first threshold depending on operating conditions of the fuel vapor canister, including a current rate of purging, temperature, air flow, etc.

If an amount of fuel vapor purged from the canister is not less than a threshold at 316, method 300 continues to purge the fuel vapor canister with the first amount of restriction between storage material in the canister and the increased vacuum at 314. However, if at 316 an amount of fuel vapor purged from the canister is less than a threshold, then method 300 proceeds to 318.

At 318, method 300 includes increasing an amount of flow restriction between storage material in the canister. For example, restriction valve 208 may be adjusted to increase an amount of flow restriction between storage material in the fuel vapor canister in response to an amount of fuel purged from the canister less than a threshold while maintaining the vent valve 204 open at a fixed set-point during the fuel vapor purging event. Increasing an amount of flow restriction in a fuel vapor canister may include restricting the communication between the first and second charcoal beds. For example, restriction valve 208 may be closed from the first set-point (which may be a fully open position as described above) to a second set-point which decreases fluidic communication between the first and second adsorbent beds. For example, at time 414 in FIG. 4, the amount of fuel vapor purged from the canister falls below second threshold 420. In response, as shown at 402, flow restriction between storage material in the canister is increased from a first amount 426 to a second larger amount 430. Further, at 318, method 300 may also include adjusting a fuel injection amount in response to the increase in flow restriction between storage material in the canister.

At 320, method 300 includes purging the fuel vapor canister with the increased amount of restriction between storage material in the canister. The increased amount of restriction between storage material in the canister may assist in increasing an efficiency of purging fuel vapor stored in the canister. For example, the increased restriction may purge fuel stored in corners or edges of the canister which were not purged previously. As shown in FIG. 4 at 406, in response to this increase in restriction between storage material in the canister after time 414, the amount of fuel vapor purged from the canister may again increase.

At 322, method 300 includes determining if an amount of fuel vapor purged from the canister is less than a threshold. For example, this threshold may be a third threshold 422 as shown in FIG. 4. In some examples, third threshold 422 may be substantially the same as the first threshold 418 or the second threshold 420. However, in other examples, third threshold 422 may be less than the first threshold 418 and/or the second threshold 420.

If an amount of fuel vapor purged from the canister is not less than a threshold at 322, method 300 continues to purge the fuel vapor canister with the increased amount of restriction between storage material in the canister at 320. In some examples, the amount of restriction between storage material in the canister may be maintained at the restriction value 430 while the purging process is continued. However, in other examples, the amount of restriction between storage material in the canister may be further increased to a value greater than restriction value 430 to further assist in fuel vapor purging.

However, if at 322 an amount of fuel vapor purged from the canister is less than a threshold, then method 300 proceeds to 324. For example, at time 416 in FIG. 4, the amount of fuel vapor purged from the canister while purging with an increased flow restriction between storage material in the canister falls below threshold 422. The amount of fuel vapor purge falling below threshold 422 may indicated that substantially all fuel vapor stored in the canister has been purged so that the fuel vapor purging event may be terminated. When the fuel vapor purging event is terminated, the flow restriction between storage material in the canister may be lowered to that a low restriction is available for subsequent non-purging events such as refueling or other venting events.

Thus, at 324, method 300 includes decreasing an amount of flow restriction between storage material in the fuel vapor canister. For example, the restriction valve 208 may be adjusted to decrease an amount of flow restriction between storage material in the fuel vapor canister following a fuel vapor purging event. In some examples, the restriction valve 208 may be adjusted to a fully open position following the fuel vapor purge event.

At 326, method 300 includes ending or terminating the fuel vapor purge event. Ending the fuel vapor purge event may include closing vent valve 204. Since the restriction valve is in a fully open position after the vapor purging event, a decreased or low amount of flow restriction is present in the canister which may be advantageous for increasing an efficiency of venting, e.g. during refueling. Additionally, a fuel injection to the engine may be adjusted during a transition between purging and non-purging conditions. The adjustment may include, for example, adjusting fuel injection responsive to the purge flow during purging conditions, and adjusting fuel injection responsive to the air flow during non-purging conditions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and nonobvious combinations and sub-combinations of the various systems and configurations, and other features, functions, and/or properties disclosed herein.

The invention claimed is:

1. A system for an engine with a fuel vapor recovery system, comprising:

a fuel vapor canister;

a restriction valve disposed in a purge flow path between storage material in the fuel vapor canister;

an atmosphere vent coupled to the fuel vapor canister and a vent valve disposed therein;

a purge conduit coupled to the fuel vapor canister and an intake of the engine;

a sensor arranged in the purge conduit; and a controller configured to:

initiate a fuel vapor purging event, including adjusting a duty-cycle of a pump in the purge conduit to provide a first amount of vacuum to the fuel vapor canister and adjusting the restriction valve to provide a first amount of flow restriction between the storage material in the fuel vapor canister;

determine, based on input from the sensor, an amount of fuel vapor purged from the fuel vapor canister;

if the amount of fuel vapor purged from the fuel vapor canister is less than a first threshold, adjust the duty-cycle of the pump to increase an amount of vacuum provided to the fuel vapor canister to a second, higher amount of vacuum while maintaining the first amount of flow restriction between the storage material in the fuel vapor canister; and after adjusting the duty-cycle of the pump, determine, based on input from the sensor, the amount of fuel vapor purged from the fuel vapor canister, and if the amount of fuel vapor purged from the fuel vapor canister is less than a second threshold, adjust the restriction valve to increase the amount of flow restriction between the storage material in the fuel vapor canister from the first amount to a second, higher amount while maintaining the duty-cycle of the pump to continue providing the second amount of vacuum to the fuel vapor canister.

2. The system of claim 1, wherein the controller is further configured to open the vent valve to a fixed position in response to the initiation of the fuel vapor purging event and close the vent valve following the fuel vapor purging event.

3. The system of claim 1, where the controller is further configured to adjust the restriction valve to decrease the amount of flow restriction between the storage material in the fuel vapor canister and adjust the duty-cycle of the pump to decrease the amount of vacuum provided to the fuel vapor canister following the fuel vapor purging event.

4. A system for an engine with a fuel vapor recovery system, comprising:

a fuel vapor canister;

a restriction valve disposed in a purge flow path between storage material in the fuel vapor canister;

an atmosphere vent coupled to the fuel vapor canister and a vent valve disposed therein;

a purge conduit coupled to the fuel vapor canister and an intake of the engine and having a purge valve arranged therein;

a sensor arranged in the purge conduit; and a controller with instructions programmed therein to:

initiate a fuel vapor purging event, the initiation including increasing opening of the purge valve to a first opening amount while maintaining the restriction valve fully open;

determine, based on input from the sensor, an amount of fuel vapor purged from the fuel vapor canister;

in response to the amount of fuel vapor purged from the fuel vapor canister decreasing below a first threshold, further increase the opening of the purge valve to a second opening amount while maintaining the restriction valve fully open;

in response to the amount of fuel vapor purged from the fuel vapor canister decreasing below a second threshold, the second threshold lower than the first threshold, decrease opening of the restriction valve while maintaining the opening of the purge valve at the second opening amount; and maintain the vent valve open throughout a duration of the fuel vapor purging event.

5. The system of claim 4, wherein the controller further includes instructions to adjust the restriction valve to increase an amount of flow restriction in response to the amount of fuel vapor purged from the fuel vapor canister less than a threshold.

6. The system of claim 4, wherein the controller further includes instructions to adjust the restriction valve to decrease the amount of flow restriction between storage material in the fuel vapor canister following the fuel vapor purging event.

7. The system of claim 4, wherein the controller further includes instructions to adjust the purge valve in the purge conduit to increase an amount of vacuum provided to the fuel vapor canister before increasing an amount of flow restriction between storage material in the fuel vapor canister.

8. The system of claim 7, wherein the controller further includes instructions to adjust the purge valve in the purge conduit to increase the amount of vacuum provided to the fuel vapor canister in response to the amount of fuel vapor purged from the fuel vapor canister less than a threshold.

9. The system of claim 4, wherein the fuel vapor canister includes a first charcoal bed in communication with a second charcoal bed and wherein the controller further includes instructions to restrict communication between the first and second charcoal beds via the restriction valve.

10. The system of claim 4, wherein the controller further includes instructions to adjust the restriction valve to increase an amount of flow restriction between storage material in the fuel vapor canister by a first amount in response to a first event and increase the amount of flow restriction between storage material in the fuel vapor canister by a second amount in response to a second event, where the second event is subsequent to the first event and where the second amount is greater than the first amount.

11. The system of claim 10, wherein the first event is the initiation of the fuel vapor purging event and the second event is the amount of fuel vapor purged from the fuel vapor canister less than a threshold.

12. The system of claim 10, wherein the first event is the amount of fuel vapor purged from the fuel vapor canister less than the first threshold and the second event is the amount of fuel vapor purged from the fuel vapor canister less than the second threshold.

13. A system for an engine with a fuel vapor recovery system, comprising:

a fuel vapor canister;

a restriction valve disposed in a purge flow path between storage material in the fuel vapor canister;

an atmosphere vent coupled to the fuel vapor canister and a vent valve disposed therein;

a purge conduit coupled to the fuel vapor canister and an intake of the engine and having a sensor arranged therein; and a controller with instructions programmed therein to:

initiate a fuel vapor purging event;

determine, based on input from the sensor, an amount of fuel vapor purged from the fuel vapor canister;

adjust the restriction valve to restrict flow between the storage material in the fuel vapor canister by a first amount;

in response to the amount of fuel vapor purged from the fuel vapor canister below a first threshold, adjust the restriction valve to restrict flow restriction between the storage material in the fuel vapor canister by a second amount, where the second amount is greater than the first amount;

in response to the amount of fuel vapor purged from the fuel vapor canister below a second threshold, adjust the restriction valve to restrict flow restriction between the storage material in the fuel vapor canister by a third amount, where the third amount is less than the second amount; and throughout a duration of the fuel vapor purging event, adjust a purge valve in the purge conduit to adjust an amount of vacuum provided to the fuel vapor canister in response to the amount of fuel vapor purged from the fuel vapor canister.

14. The system of claim 13, wherein the controller further includes instructions to initiate the fuel vapor purging event by opening the vent valve coupled to the fuel vapor canister and maintaining the vent valve open at a fixed position throughout the duration of the fuel vapor purging event.

15. The system of claim 13, wherein the third amount of restriction is substantially the same as the first amount of restriction and flow restriction between the storage material in the fuel vapor canister is maintained at the first amount following the fuel vapor purging event.

16. The system of claim 13, wherein the controller further includes instructions to adjust the purge valve in the purge conduit to increase the amount of vacuum provided to the fuel vapor canister before restricting flow restriction between the storage material in the fuel vapor canister by the second amount.

17. The system of claim 16, wherein the controller further includes instructions to adjust the purge valve in the purge conduit to increase the amount of vacuum provided to the fuel vapor canister in response to the amount of fuel vapor purged from the fuel vapor canister below a third threshold.

18. The system of claim 13, wherein the fuel vapor canister includes a first charcoal bed in communication with a second charcoal bed and wherein the controller further includes instructions to restrict communication between the first and second charcoal beds.

19. The system of claim 4, wherein the controller further includes instructions to adjust a fuel injection amount in response to an adjustment to an amount of vacuum provided to the fuel vapor canister.

* * * * *